US011598160B1

(12) United States Patent
Wai

(10) Patent No.: US 11,598,160 B1
(45) Date of Patent: Mar. 7, 2023

(54) DOWNHOLE CUTTING TOOL POSITIONING ASSEMBLIES AND METHODS TO CUT A TUBULAR

(71) Applicant: Halliburton Energy Services, Inc., Houston, TX (US)

(72) Inventor: Simon Whye Kwong Wai, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/561,405

(22) Filed: Dec. 23, 2021

(51) Int. Cl.

| | |
|---|---|
| ***E21B 29/08*** | (2006.01) |
| ***E21B 17/10*** | (2006.01) |
| ***E21B 17/06*** | (2006.01) |
| ***E21B 29/00*** | (2006.01) |
| ***E21B 23/01*** | (2006.01) |

(52) U.S. Cl.
CPC ..... *E21B 17/1014* (2013.01); *E21B 17/06* (2013.01); *E21B 23/01* (2013.01); *E21B 29/00* (2013.01); *E21B 29/08* (2013.01)

(58) Field of Classification Search
CPC ..... E21B 29/08; E21B 29/00; E21B 23/01; E21B 17/1074; E21B 17/06
See application file for complete search history.

(56) References Cited

U.S. PATENT DOCUMENTS

| | | | | |
|---|---|---|---|---|
| 4,126,179 | A | 11/1978 | Long | |
| 4,561,499 | A * | 12/1985 | Berner, Jr. | E21B 33/043 166/341 |
| 6,896,077 | B1 | 5/2005 | Gunsaulis et al. | |
| 8,453,728 | B2 | 6/2013 | Heburn | |
| 9,416,609 | B2 | 8/2016 | Robertson et al. | |
| 9,909,376 | B2 * | 3/2018 | Hrametz | E21B 23/08 |
| 11,066,909 | B2 * | 7/2021 | Yin | E21B 43/12 |
| 2010/0258293 | A1 | 10/2010 | Lynde et al. | |
| 2012/0013133 | A1 * | 1/2012 | Rios, III | E21B 23/01 292/159 |

(Continued)

FOREIGN PATENT DOCUMENTS

| | | | |
|---|---|---|---|
| CA | 2643206 | A1 | 8/2004 |
| WO | 2020139750 | A1 | 7/2020 |

OTHER PUBLICATIONS

International Search Report and Written Opinion dated Sep. 8, 2022 in PCT/US2021/065762 (10 pages).

*Primary Examiner* — Yong-Suk (Philip) Ro
(74) *Attorney, Agent, or Firm* — Barnes & Thornburg, LLP

(57) ABSTRACT

Downhole cutting tool positioning assemblies and methods to cut a tubular are presented. The assembly includes a drive screw, a drive nut coupled to the drive screw and configured to shift from a first position to a second position as the drive screw rotates in a first drive screw direction, a pressure piston configured to shift from a first position to a second position in response to force applied to the pressure piston, a chamber having a pressure fluid that is pressurized by the pressure piston as the pressure piston shifts from the first position towards the second position, a sleeve configured to slide from a first position towards a second position in response to pressure from the pressure fluid, and a latch key having a profile configured to shift radially to engage a tubular groove as the sleeve shifts from the first position towards the second position.

20 Claims, 6 Drawing Sheets

(56) References Cited

U.S. PATENT DOCUMENTS

| | | | | |
|---|---|---|---|---|
| 2017/0107792 | A1 | 4/2017 | Lee | |
| 2018/0230764 | A1 | 8/2018 | Robertson et al. | |
| 2021/0324710 | A1* | 10/2021 | Mair | E21B 23/04 |

* cited by examiner

DOWNHOLE CUTTING TOOL POSITIONING ASSEMBLIES AND METHODS TO CUT A TUBULAR

BACKGROUND

The present disclosure relates generally to downhole cutting tool positioning assemblies and methods to cut a tubular.

Tubulars, such as strings, pipes, coiled tubing, and production tubing are often run into a wellbore to provide an interior passageway for fluids, tools, equipment, and other materials to travel from the surface downhole, and from a downhole location to the surface while insulating and protecting the fluids, tools, equipment, and other materials. A tubular is sometimes first run into the wellbore, and a downhole cutting is subsequently run into the wellbore to perform one or more cuts to the tubular.

BRIEF DESCRIPTION OF THE DRAWINGS

Illustrative embodiments of the present disclosure are described in detail below with reference to the attached drawing figures, which are incorporated by reference herein, and wherein.

Figure 1:
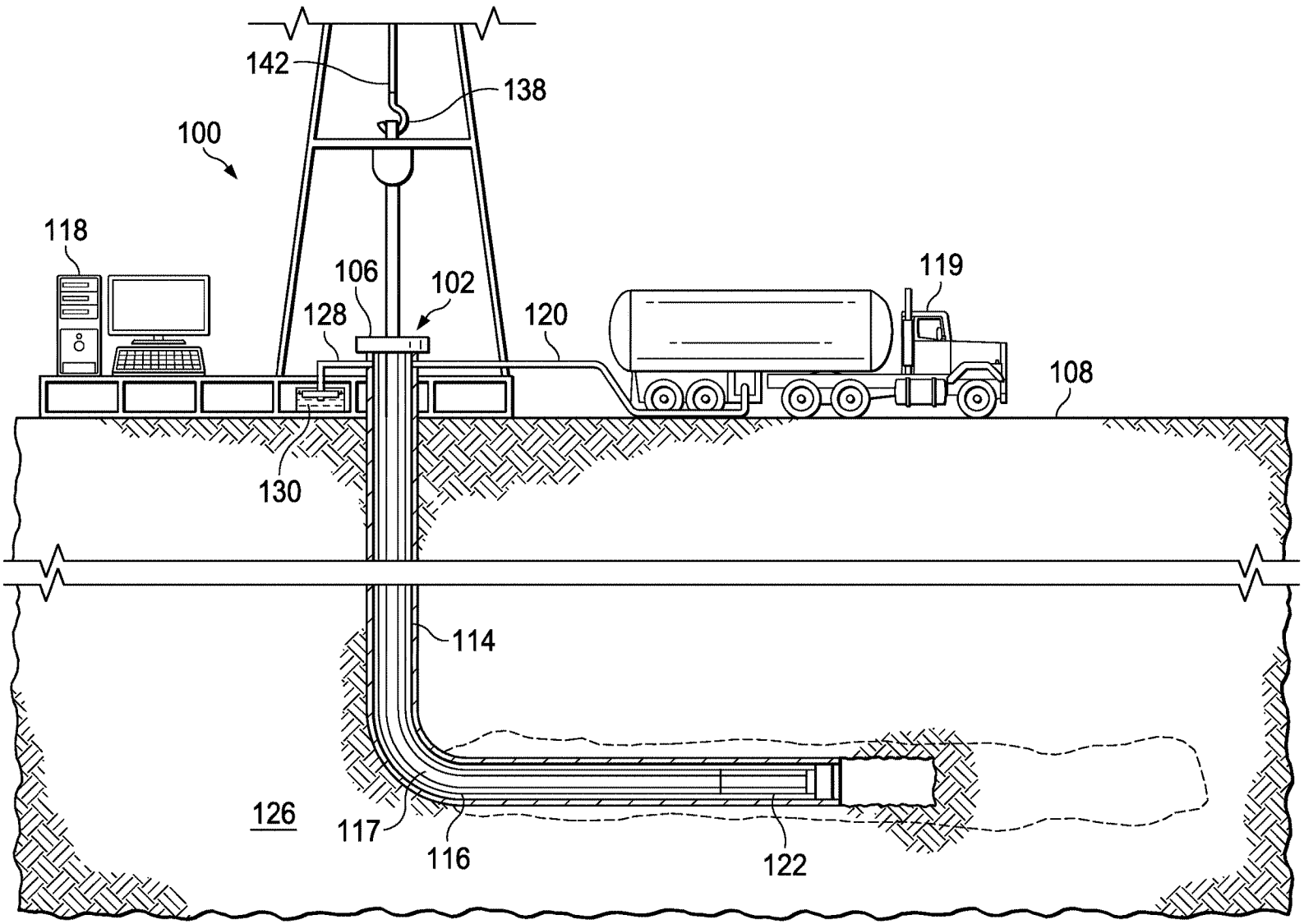
FIG. 1 is a schematic, side view of a completion environment that includes a wellbore having a downhole cutting tool positioning assembly deployed in a downhole tubular to perform a cutting operation.

The illustrated figures are only exemplary and are not intended to assert or imply any limitation with regard to the environment, architecture, design, or process in which different embodiments may be implemented.

DETAILED DESCRIPTION

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

The present disclosure relates to downhole cutting tool positioning assemblies and methods to cut a tubular. Downhole cutting tool positioning assembly includes a pressure generation sub-assembly and an anchoring sub-assembly. In some embodiments, the pressure generation sub-assembly includes a drive screw, a drive nut, a pressure piston, a spring, and a chamber. As referred to herein, a drive screw is a mechanism that converts rotary motion into linear motion that combines a screw and a nut. Examples of drive screws include, but are not limited to, lead screws, ball screws, and other types of mechanisms that convert rotary motion to linear motion. Further, in some embodiments, the anchoring sub-assembly includes a sleeve, an anchor piston, a slider hub, a fixed hub, a latch key, and linkages.

The drive screw is coupled to the drive nut and configured to rotate in one direction (e.g., clockwise direction) to shift the drive nut from a first drive nut position towards a second drive nut position, and rotate in the second direction (e.g., counterclockwise direction) to shift the drive nut from the second drive nut position towards the first drive nut position. In some embodiments, the first drive nut position is the initial position of the drive nut, whereas the second position of the drive nut is the position of the drive nut at the end of a stroke of the pressure piston when the pressure piston is fully extended. The pressure piston is positioned near the drive nut such that the pressure piston is shifted from a first pressure piston position towards a second pressure piston position as the drive nut shifts from the first drive nut position towards the second drive nut position. In some embodiments, a spring is positioned between the drive nut and the pressure piston such that the spring is compressed from a natural position to a compressed position as the drive nut shifts from the first drive nut position towards the second drive nut position. Moreover, force generated by the spring returning to the natural position shifts the pressure piston from the first pressure piston position towards the second pressure piston position. In some embodiments, the first pressure piston position is the initial position of the pressure piston, whereas the second pressure piston position is the position of the pressure piston at the end of a stroke of the pressure piston when the pressure piston is fully extended. In some embodiments, where the drive nut (directly or indirectly) contacts the pressure piston as the drive nut shifts from the first position towards the second position, force applied by the drive nut shifting from the first position towards the second position, in turn, shifts the pressure piston from the first pressure piston position towards the second pressure piston position.

The piston is positioned within or adjunct to the chamber that is partially or completely filled with a fluid, such that as the pressure piston shifts from the first pressure piston position towards the second pressure piston position, force applied by the pressure piston, in turn, pressurizes the fluid. In some embodiments, a port provides a fluid flow path for the fluid to flow from the chamber to the anchor piston or to a chamber housing the anchor piston, such that the pressurized fluid applies pressure or force to the anchor piston to shift the anchor piston from a first anchor piston position to a second anchor piston position. In some embodiments, the chamber is a cylinder. In some embodiments, the chamber has a non-cylindrical shape. The anchor piston is coupled to a sleeve (such as an outer sleeve) that is configured to shift from a first sleeve position to a second sleeve position as the anchor piston shifts from the first anchor piston position toward the second anchor piston position. In some embodiments, the anchor piston is coupled to the sleeve via a key. As referred to herein, a key is any component configured to connect the anchor piston and the sleeve to secure the sleeve to the anchor piston to prevent relative movement. In some embodiments, the key connects the anchor piston and the sleeve to form a keyed joint to secure the sleeve to the anchor piston. In some embodiments, the key is formed from a metallic material or another type of material having properties that secures the sleeve to the anchor piston to prevent relative movement of the sleeve with respect to the anchor piston.

The sleeve is also coupled to a slider hub that is configured to shift from a first slider hub position to a second slider hub position as the sleeve shifts from the first sleeve position to the second sleeve position. As referred to herein, a slider hub is any hub that is configured to shift or slide from one position to a second position, and a fixed hub is any hub that is in a fixed location. The slider hub and the fixed hub are each coupled to an end of one of two linkages that have second ends that are joined to each other and to the latch key at a bendable joint. Moreover, as the slider hub shifts from the first slider hub position to the second slider hub position towards the fixed hub, the two linkages bend at the bendable joint to shift the latch key in a radial direction. As referred to herein, a radial direction is a direction towards the wall of the tubular or wellbore. In some embodiments, the latch key has a profile that complements a profile of a pre-formed groove of the tubular. In one or more of such embodiments, the slider hub is shifted from the first slider hub position to the second slider hub position to radially shift the latch key into the tubular groove.

In some embodiments, after the downhole cutting tool positioning assembly is run into a tubular, the downhole cutting tool positioning assembly performs a search operation to locate and to fit the latch key into the tubular groove. In some embodiments, while the downhole cutting tool positioning assembly traverses the tubular, the downhole cutting tool positioning assembly identifies one or more location profiles in the tubular to determine the relative location of the downhole cutting tool positioning assembly with respect to the location of the cut window for making a desired cut to the tubular. In one or more of such embodiments, after the downhole cutting tool positioning assembly is positioned at or near the cut window, the drive screw is rotated or caused to rotate (e.g., by a motor coupled to the drive screw) in the first direction to drive the drive nut towards a second drive nut position, which, in turn, applies force to the spring positioned between the drive nut and the pressure piston, compressing the spring. The force of the spring return from the compressed state to the natural state, in turn, shifts the pressure piston, which pressurizes the fluid, and the operations described in the foregoing paragraphs are performed to radially shift the latch key into the tubular groove, thereby completing the search operation. In some embodiments, the drive nut is not in contact with the piston during the search operation and force released by the spring positioned between the drive nut and the pressure piston returning to the natural state shifts the pressure piston from the first pressure piston position towards the second pressure piston position. In some embodiments, after completion of the search operation, and the latch key is positioned in the tubular groove, the downhole cutting tool positioning assembly performs additional operations including adjusting the location, positioning, and orientation of the blade to ensure the blade is positioned within a cutting window and oriented in a desired orientation to cut the tubular.

In some embodiments, after the search operation is complete, the downhole cutting tool positioning assembly performs an anchor operation. At the commencement of the anchor operation, the drive screw is further rotated or caused to rotate in the first direction to further drive the drive nut towards the pressure piston. As the drive nut contacts the pressure piston, the drive nut applies additional force to the pressure piston, which shifts the pressure piston to the second pressure piston position. The force applied by the drive nut onto the pressure piston, in turn, further pressurizes the fluid as the pressure piston shifts towards the second pressure piston position. The additional force applied to the fluid, in turn, applies additional pressure or force to the anchor piston, the sleeve, the slider hub, and the linkages, as described in the paragraphs above, to maintain the latch key in the tubular groove during the anchoring operation. In some embodiments, the downhole cutting tool positioning assembly performs a cutting operation during the anchoring operation while the latch key is maintained in the tubular groove by the additional force generated from shifting the drive nut and the pressure piston to their respective second drive nut and pressure piston positions, respectively. In one or more of such embodiments, some or all of the additional force generated from shifting the drive nut and the pressure piston is translated to the latch key, and the translated force is applied by the latch key to the tubular groove to maintain and anchor the latch key in the tubular groove during a cutting operation.

In some embodiments, after completion of the anchor operation, the drive screw is rotated or caused to rotate in a second direction to shift the drive nut from the second drive nut position towards the first drive nut position. In some embodiments, the pressure piston is coupled to the drive nut such that the pressure piston shifts from the second pressure piston position towards the first pressure piston position as the drive nut shifts from the second drive nut position towards the first drive nut position. Further, force or pressure applied to the fluid is reduced as the pressure piston shifts from the second pressure piston position towards the first pressure piston position, which, in turn, reduces the force or pressure applied to the anchor position, thereby shifting the anchor piston or causing the anchor piston to shift from the second anchor piston position towards the first anchor piston position. The anchor piston, in turn, shifts the sleeve from the second sleeve position towards the first sleeve position as the anchor piston shifts from the second anchor piston position towards the first anchor piston position. The sleeve, in turn, shifts the slider hub from the second slider hub position towards the first slider hub position as the sleeve shifts from the second sleeve position towards the first sleeve position. Further, the slider hub shifts one of the linkages that is coupled to the latch key as the slider hub shifts from the second slider hub position towards the first slider hub position, thereby reducing the force applied by the latch key to the tubular groove and shifting the latch key out of the tubular groove. In some embodiments, after the latch key is shifted out of the tubular groove, the downhole cutting tool positioning assembly performs the operations described herein to traverse to additional locations of the tubular, and performs additional search, anchor, and cutting operations. In some embodiments, the downhole cutting tool positioning assembly is retrieved from the tubular after making the desired cut. Additional descriptions of downhole cutting tool positioning assemblies and methods to cut a tubular are provided in the paragraphs below and are illustrated in FIGS. 1-7.

Turning now to the figures, FIG. 1 is a schematic, side view of a completion environment 100 that includes a wellbore 114 having a downhole cutting tool positioning assembly 122 deployed in the wellbore 114 deployed in a tubular 116 to perform a cutting operation. As shown in FIG. 1, wellbore 114 extends from surface 108 of well 102 to or through formation 126. Downhole cutting tool positioning assembly 122 is coupled to a conveyance 117 that is run in wellbore 114. More particularly, a hook 138, a cable 142, traveling block (not shown), and hoist (not shown) are provided to lower conveyance 117 and downhole cutting tool positioning assembly 122 into tubular 116. As referred to herein, a conveyance 117 may be a work string, drill string, drill pipe, wireline, slickline, coiled tubing, production tubing, downhole tractor or another type of conveyance operable to be deployed downhole cutting tool positioning assembly 122 to perform operations described herein to perform one or more cutting operations.

At wellhead 106, an inlet conduit 120 is coupled to a fluid source 119 to provide fluids and materials, such as cutting fluids to a blade (not shown) of downhole cutting tool positioning assembly 122 during a cutting operation downhole. In the embodiment of FIG. 1, fluids are circulated into well 102 through tubular 116 or conveyance 117 and back toward surface 108. To that end, a diverter or an outlet conduit 128 may be connected to a container 130 at the wellhead 106 to provide a fluid return flow path from wellbore 114.

After downhole cutting tool positioning assembly 122 is run downhole, downhole cutting tool positioning assembly 122 performs a search operation to shift a latch key (not shown) into a tubular groove (illustrated in FIG. 2) of tubular 116, performs an anchor operation to apply sufficient force from latch key to the tubular groove to anchor downhole cutting tool positioning assembly 122 during subsequent operations, including a cutting operation to cut tubular 116. In some embodiments, downhole cutting tool positioning assembly 122, after completing a cutting operation, performs operations described herein to shift the latch key out of the tubular groove, and is retrieved from wellbore 114. In some embodiments, downhole cutting tool positioning assembly 122, after completing a cutting operation, performs operations described herein to shift the latch key out of the tubular groove, traverses to a second location of tubular 116, and performs the search, anchor, and cutting operations to make a second cut to tubular 116 at or near the second location of tubular 116. Additional descriptions and illustrations of downhole cutting tool positioning assemblies are provided in the paragraphs below and are illustrated in at least FIGS. 2-6. Further, additional descriptions and illustrations of methods to cut a tubular are provided in the paragraphs below and are illustrated in at least FIG. 7.

In the embodiment of FIG. 1, operations described herein are monitored by controller 118 at surface 108. Although FIG. 1 illustrates controller 118 as surface-based devices, in some embodiments, one or more components of controllers 118 are located downhole. Further, in some embodiments, controllers 118 are located at a remote location. Further, in some embodiments, controller 118 is a component of the downhole cutting tool positioning assembly 122. In some embodiments, controller 118 provides the status of one or more operations performed by downhole cutting tool positioning assembly 122 for display. In one or more of such embodiments, an operator, having access to controller 118, operates controller 118 to make adjustments to one or more components of downhole cutting tool positioning assembly 122, and to monitor and/or control search operations, anchor operations, cutting operations, as well as other operations described herein. In some embodiments, controller 118 dynamically monitors, analyzes, and make adjustments to one or more operations described herein.

Although FIG. 1 illustrates a cased wellbore, downhole cutting tool positioning assembly 122, illustrated in FIG. 1, as well as other downhole cutting tool positioning assemblies described herein, are deployable in open-hole wellbores, and cased wellbores and open-hole wellbores of offshore wells. Further, although FIG. 1 illustrates downhole cutting tool positioning assembly 122 deployed in a horizontal section of wellbore 114, in some embodiments, downhole cutting tool positioning assembly 122 performs the operations described herein while located in a vertical section of wellbore 114, or in a transition section of wellbore 114. Further, although FIG. 1 illustrates a completion environment 100, downhole cutting tool positioning assembly 122 and other downhole cutting tool positioning assemblies described herein are also deployable in other well environments to make tubular cuts.

Figure 2:
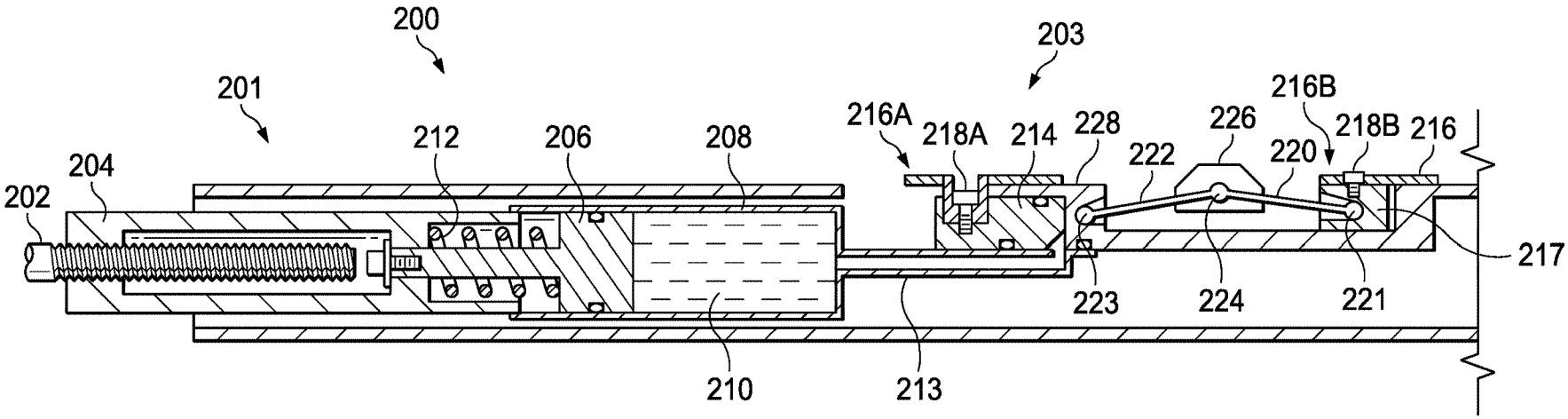
FIG. 2 is a cross-sectional view of a downhole cutting tool positioning assembly similar to the downhole cutting tool positioning assembly of FIG. 1 and deployed in the wellbore of FIG. 1.

FIG. 2 is a cross-sectional view of a downhole cutting tool positioning assembly 200 similar to the downhole cutting tool positioning assembly 122 of FIG. 1 and deployed in wellbore 114 of FIG. 1. In the embodiment of FIG. 2, a drive screw 202 is coupled to a drive nut 204 and configured to rotate or cause to be rotated in one direction to shift drive nut 204 from a first drive nut position illustrated in FIG. 2 towards a second drive nut position as illustrated in FIG. 5D, and rotate in another direction to shift drive nut 204 from the second drive nut position towards the first drive nut position. A pressure piston 206 is positioned near drive nut 204 and is shiftable from a first pressure piston position illustrated in FIG. 2 towards a second pressure piston position as illustrated in FIG. 5D as drive nut 204 shifts from the first drive nut position towards the second drive nut position. A spring 212 is positioned between drive nut 204 and pressure piston 206 such that spring 212 is compressed from a natural position illustrated in FIG. 2 to a compressed position as illustrated in FIG. 3B as drive nut 204 shifts from the first drive nut position towards the second drive nut position.

Pressure piston 206 is positioned within or adjunct to a chamber 208 that is partially or completely filled with a fluid 210. Fluid 210 is pressurized by pressure piston 206 as pressure piston 206 shifts from the first pressure piston position towards the second pressure piston position. Moreover, pressurized fluid 210 travels through port 213 to an anchor piston 214 or a housing of anchor piston 214 (not shown). Anchor piston 214 is positioned adjacent to a fixed hub 228 and is shiftable from a first position illustrated in FIG. 2 to a second anchor piston position illustrated in FIG. 3B in response to pressure or force applied by pressurized fluid 210. Anchor piston 214 is coupled to a first section 216A of a sleeve 216 by a key 218A. Sleeve 216 is shiftable from a first sleeve position illustrated in FIG. 2 to a second sleeve position illustrated in FIG. 3B as anchor piston 214 shifts from the first anchor piston position toward the second anchor piston position. Sleeve 216 also has a second section 216B that is coupled to a slider hub 217 that is shiftable from a first slider hub position illustrated in FIG. 2 to a second slider hub position illustrated in FIG. 3B as sleeve 216 shifts from the first sleeve position to the second sleeve position. Slider hub 217 and fixed hub 228 are each engaged to a first end 221 and 223 of a first linkage 220 and a second linkage 222, respectively. Further, each of first linkage 220 and second linkage 222 has a second end that are joined to each other and to a latch key 226 at a bendable joint 224. As slider hub 217 shifts from the first slider hub position to the second slider hub position towards the fixed hub 228, first linkage 220 and second linkage 222 bend at bendable joint 224 to shift latch key 226 from the initial position illustrated in FIG. 2 radially to a second position illustrated in FIG. 3B. Latch key 226 has a profile that complements a profile of a pre-formed tubular groove, such as a tubular groove illustrated in FIG. 3B. In the embodiment of FIG. 2, drive screw 202, drive nut 204, pressure piston 206, spring 212, and chamber 208 together form a pressure generation sub-assembly 201 of downhole cutting tool positioning assembly 200. Further, in the embodiment of FIG. 2, sleeve 216, anchor piston 214, slider hub 217, fixed hub 228, latch key 226, first linkage 220, and second linkage 222 together form an anchoring sub-assembly 203 of downhole cutting tool positioning assembly 200. Additional description of positions of the components of downhole cutting tool positioning assembly 200 during different operations are provided below and are illustrated in at least 3A-3B, 4, and 5A-5D.

Figure 3A:
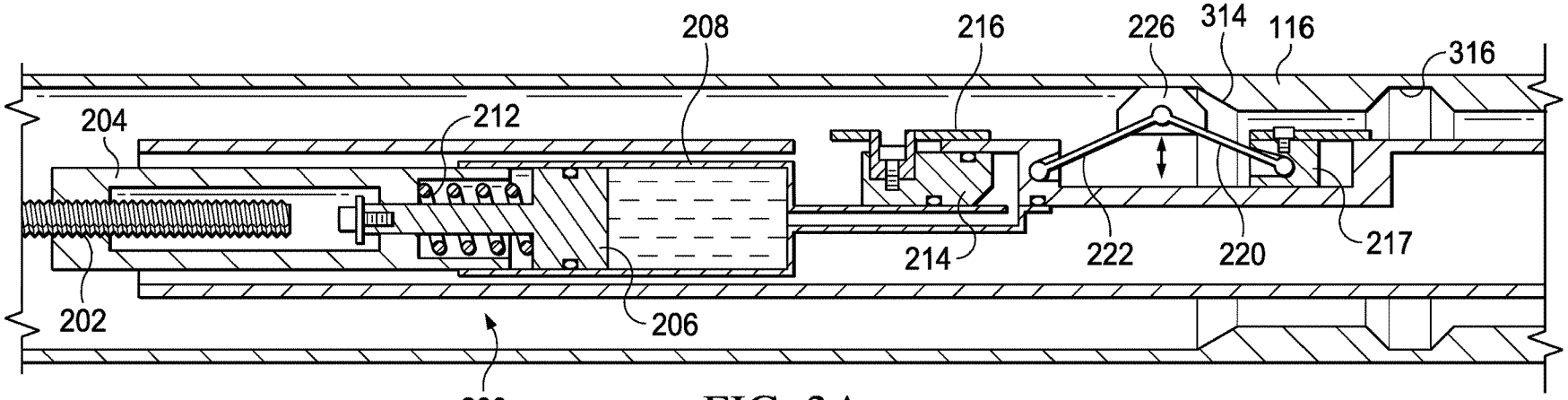
FIG. 3A is a cross-sectional view of the cutting tool positioning assembly of FIG. 2 at the commencement of a search operation.

In that regard, FIG. 3A is a cross-sectional view of downhole cutting tool positioning assembly 200 of FIG. 2 at the commencement of a search operation. In the embodiment of FIG. 3A, downhole cutting tool positioning assembly 200 identifies the presence of a location profile 314 in tubular 116, which is an indication that a tubular groove 316 for latch key 226 to shift into during search, anchor, and cutting operations, is nearby. In the embodiment of FIG. 3A, tubular groove 316 has a profile that matches a corresponding profile of latch key 226. The positioning of drive screw 202, drive nut 204, pressure piston 206, spring 212, chamber 208, anchor piston 214, sleeve 216, slider hub 217, first linkage 220, second linkage 222, and latch key 226 of downhole cutting tool positioning assembly 200 as illustrated in FIG. 3A are similar or identical to the positioning of drive screw 202, drive nut 204, pressure piston 206, spring 212, chamber 208, anchor piston 214, sleeve 216, slider hub 217, first linkage 220, second linkage 222, and latch key 226 of downhole cutting tool positioning assembly 200 as illustrated in FIG. 2 and described in the paragraphs herein.

Figure 3B:
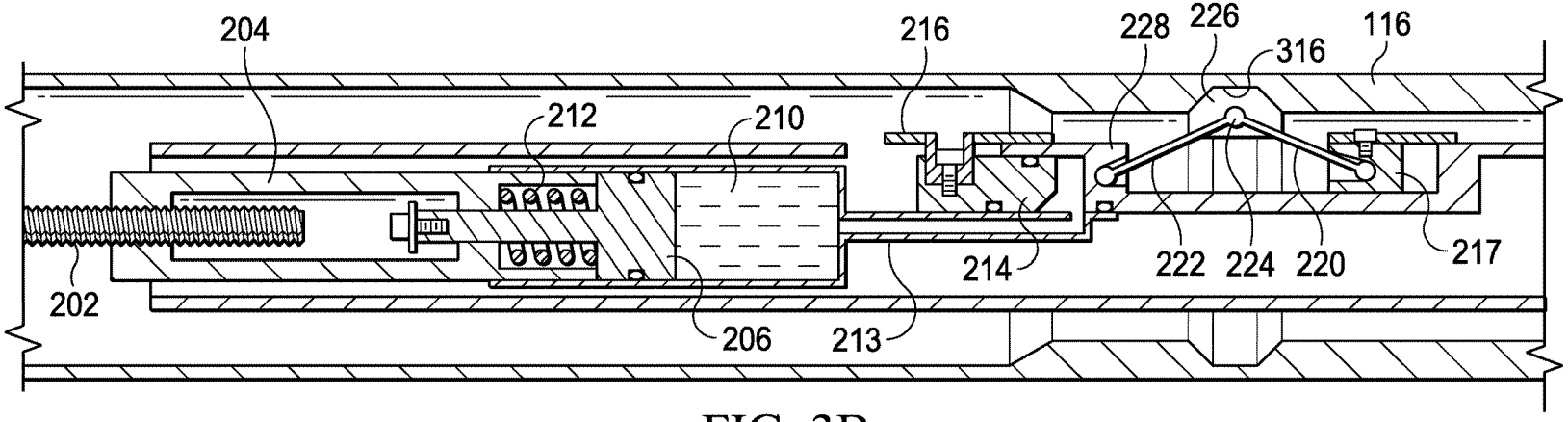
FIG. 3B is a cross-sectional view of the cutting tool positioning assembly of FIG. 3A, after the latch key has shifted into the groove of the downhole tubular.

FIG. 3B is a cross-sectional view of downhole cutting tool positioning assembly 200 of FIG. 3A, after latch key 226 is shifted into tubular groove 316 of the downhole tubular 116. In the embodiment of FIG. 3B, drive screw 202 is rotated or caused to be rotated in the first direction, which, in turn, has shifted drive nut 204 from the first drive nut position illustrated in FIG. 2 to a third drive nut position illustrated in FIG. 3B that is between the first position and the second drive nut position as illustrated in FIG. 5D. The shifting of drive nut 204 from the first drive nut position to the third drive nut position, in turn, has compressed spring 212 from the natural state illustrated in FIG. 3A to a compressed state as illustrated in FIG. 3B. Force released by spring 212 returning to the natural state, in turn, applies force to pressure piston 206, thereby shifting pressure piston 206 from the first pressure piston position illustrated in FIG. 3A to a third pressure piston position illustrated in FIG. 3B that is in between the first pressure piston position and the second pressure piston position. Further, FIG. 3B also illustrates the moment drive nut 204 contacts pressure piston 206.

Pressure piston 206 pressurizes fluid 210 as pressure piston 206 shifts from the first pressure piston position to the third pressure piston position. The pressurized fluid 210 flows through port 213, contacts anchor piston 214, and shifts anchor piston 214 from the first anchor piston position illustrated in FIG. 3A to the second anchor piston position illustrated in FIG. 3B. Anchor piston 214 is coupled to sleeve 216 such that the shifting of anchor piston 214 from the first anchor piston position to the second anchor piston position also shifts sleeve 216 from the first sleeve position illustrated in FIG. 3A to the second sleeve position illustrated in FIG. 3B. Sleeve 216 is coupled to slider hub 217 such that the shifting of sleeve 216 also shifts slider hub 217 from the first slider hub position illustrated in FIG. 3A to the second slider hub position illustrated in FIG. 3B. Slider hub 217 and fixed hub 228 are each engaged to first linkage 220 and a second linkage 222, respectively, where first linkage 220 and second linkage 222 are joined to each other and to latch key 226 at bendable joint 224. Moreover, the shifting of slider hub 217 from the first slider hub position to the second slider hub position bends bendable joint 224, and shifts latch key 226 radially outwards and into tubular groove 316 of tubular 116. In the embodiment of FIG. 3B, force translated to latch key 226, and from latch key 226 to tubular groove 316 is sufficient to prevent premature shifting or movement of downhole cutting tool positioning assembly 200 during other operations prior to the cutting operation. In one or more of such embodiments, downhole cutting tool positioning assembly 200 adjusts or aligns a blade of downhole cutting tool positioning assembly 200 or performs other pre-cutting operations after latch key 226 is shifted into tubular groove 316, and before downhole cutting tool positioning assembly 200 initiates an anchoring operation.

Figure 4:
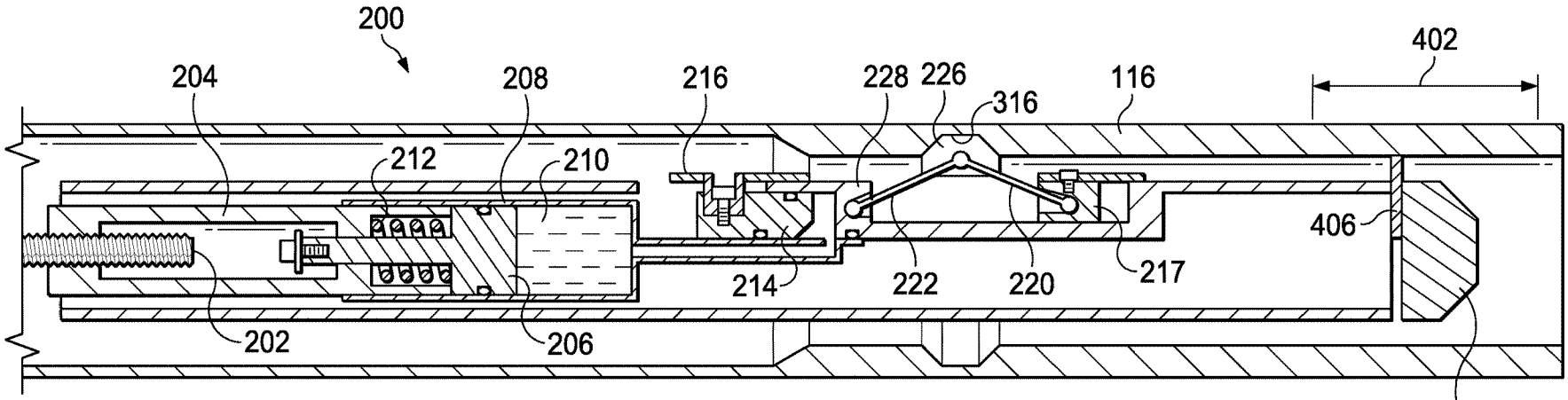
FIG. 4 is a cross-sectional view of the downhole cutting tool positioning assembly of FIG. 3B after the latch key has shifted into the groove of the downhole tubular and at the commencement of an anchor operation.

FIG. 4 is a cross-sectional view of the downhole cutting tool positioning assembly of FIG. 3B after the latch is shifted into the groove of the downhole tubular and at the commencement of an anchor operation. The positioning of drive screw 202, drive nut 204, pressure piston 206, spring 212, chamber 208, anchor piston 214, sleeve 216, slider hub 217, first linkage 220, second linkage 222, and latch key 226 of downhole cutting tool positioning assembly 200 as illustrated in FIGS. 3A and 3B are similar or identical to positioning of drive screw 202, drive nut 204, pressure piston 206, spring 212, chamber 208, anchor piston 214, sleeve 216, slider hub 217, first linkage 220, second linkage 222, and latch key 226 of downhole cutting tool positioning assembly 200 as illustrated in FIG. 4 and described in the paragraphs herein. Further, cutter head 404 and blade 406 are both positioned within a cutting window 402 of a desired cut to tubular 116. An anchor operation described herein is performed to shift drive nut 204 from the third drive nut position illustrated in FIG. 4 to the second drive nut position illustrated in FIG. 5D. The force of drive nut 204 shifting from the third drive nut position to the second drive nut position shifts pressure piston 206 from the third pressure piston position illustrated in FIG. 4 to the second pressure piston position illustrated in FIG. 5D, which, in turn, further pressurizes fluid 210. Force or pressure of the pressurized fluid 210 interacting with anchor piston 214 are, in turn, translated to sleeve 216, from sleeve 216 to slider hub 217, from slider hub 217 to first and second linkages 220 and 222, from first and second linkages 220 and 222 to latch key 226, and from latch key 226 to tubular groove 316. The additional force applied from latch key 226 to tubular groove 316 anchors latch key 226 into tubular groove 316 during the cutting operation to prevent premature shifting or movement of downhole cutting tool positioning assembly 200 during the cutting operation. In some embodiments, the distance between blade 406 and latch key 226 is adjustable, and is adjusted prior to the cutting operation to make a cut within cutting window 402.

Figure 5A:
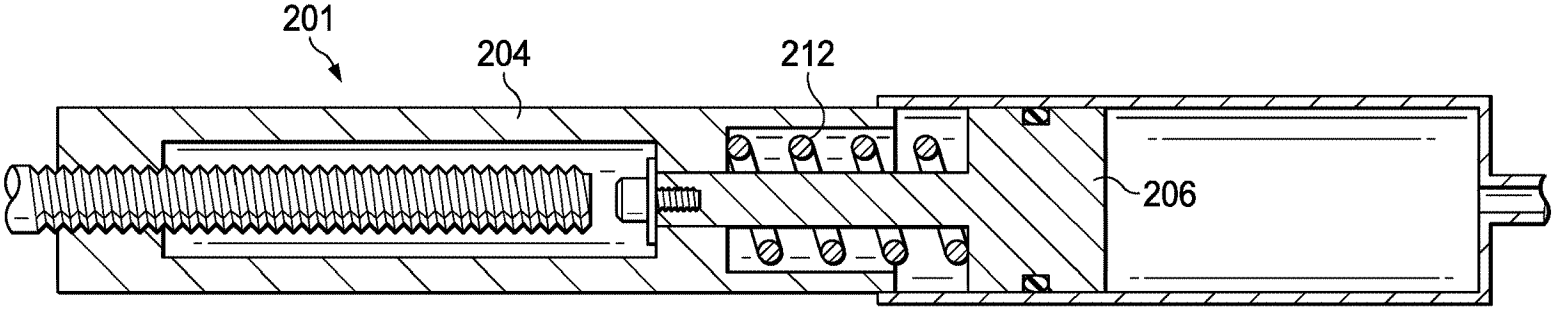
FIG. 5A is a cross-sectional view of the pressure generation sub-assembly of the downhole cutting tool positioning assembly of FIG. 2 at the commencement of a search operation.
Figure 5B:
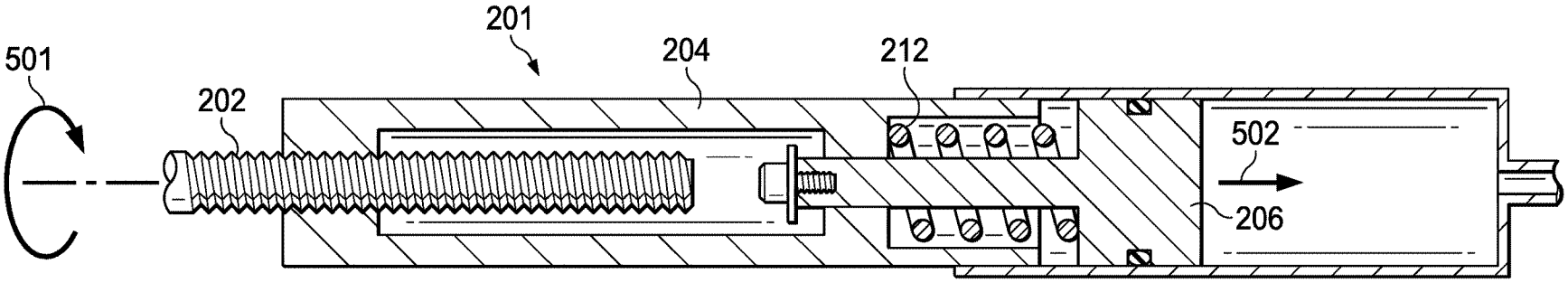
FIG. 5B is a cross-sectional view of the pressure generation sub-assembly of FIG. 5A during the search operation.

FIG. 5A is a cross-sectional view of the pressure generation sub-assembly 201 of downhole cutting tool positioning assembly 200 of FIG. 2 at the commencement of a search operation. In the embodiment of FIG. 5A, drive nut 204 and pressure piston 206 are in the first drive nut position and the first pressure piston position, respectively. Further, spring 212 is in the natural state. FIG. 5B is a cross-sectional view of pressure generation sub-assembly 201 of FIG. 5A during the search operation. In the embodiment of FIG. 5B, drive screw 202 is rotated in a direction illustrated by arrow 501, which, in turn, shifts drive nut 204 from the first drive nut position illustrated in FIG. 5A towards the second drive nut position illustrated in FIG. 5D. The shifting of drive nut 204 from the first drive nut position towards the second drive nut position, in turn, compresses spring 212 to a compressed state. Moreover, force applied by spring 212 returning from the compressed state to a natural state, in turn, linearly shifts pressure piston 206 in a direction illustrated by arrow 502 and from the first pressure piston position illustrated in FIG. 5A towards the second pressure piston position illustrated in FIG. 5D.

Figure 5C:
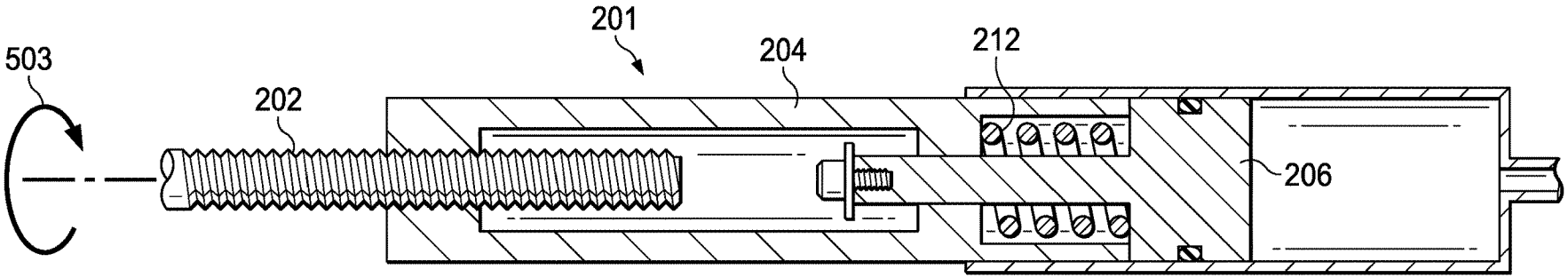
FIG. 5C is a cross-sectional view of the pressure generation sub-assembly of FIG. 5B after completion of the search operation and at the beginning of an anchor operation.
Figure 5D:
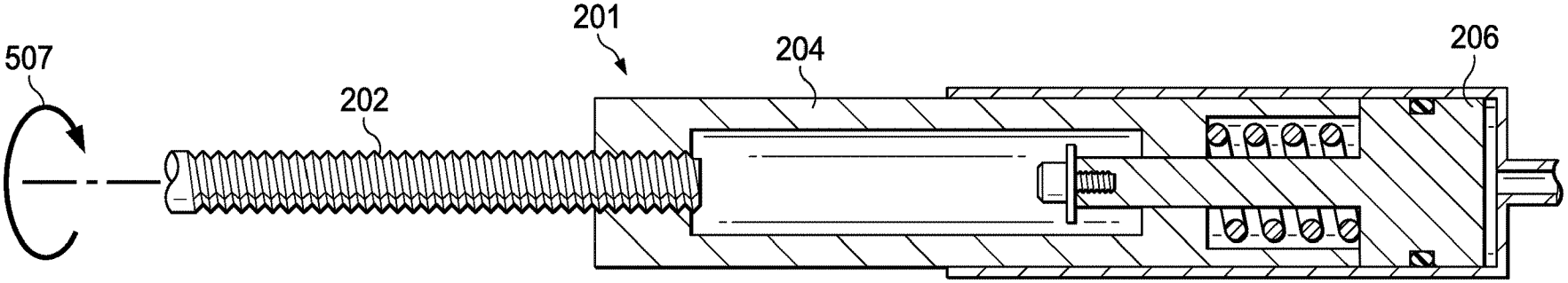
FIG. 5D is a cross-sectional view of the pressure generation sub-assembly of FIG. 5C at the completion of the anchor operation.

FIG. 5C is a cross-sectional view of pressure generation sub-assembly 201 of FIG. 5B after completion of the search operation and at the beginning of an anchor operation. In the embodiment of FIG. 5C, drive screw 202 is rotated in a direction illustrated by arrow 503, which, in turn, shifts drive nut 204 from the drive nut position illustrated in FIG. 5B to the third drive nut position illustrated in FIG. 5C, which is in between the first drive nut position and the second drive nut position. The shifting of drive nut 204 from the drive nut position illustrated in FIG. 5B to the third drive nut position further compresses spring 212. Moreover, drive nut 204 contacts pressure piston 206 while drive nut 204 and pressure piston 206 are in the third drive nut position and the third piston position, respectively, such that further shifting of drive nut 204 applies additional force onto pressure piston 206 as drive nut 204 shifts towards the second drive nut position.

FIG. 5D is a cross-sectional view of pressure generation sub-assembly 201 of FIG. 5C at the completion of the anchor operation. In the embodiment of FIG. 5D, drive screw 202 is rotated in a direction illustrated by arrow 507, which, in turn, shifts drive nut 204 from the third drive nut position illustrated in FIG. 5C to the second drive nut position illustrated in FIG. 5D. The shifting of drive nut 204 from the third drive nut position illustrated in FIG. 5C to the second drive nut position illustrated in FIG. 5D, in turn, shifts pressure piston 206 from the third piston position illustrated in FIG. 5C to the second piston position illustrated in FIG. 5D. Pressure piston 206 applies a maximum amount of force or pressure to fluid 210 of FIG. 2 as pressure piston 206 is in the second pressure piston position. Force or pressure of the fluid interacting with anchor piston 214 of FIG. 2 are, in turn, translated to sleeve 216 of FIG. 2, from sleeve 216 to slider hub 217 of FIG. 2, from slider hub 217 to first and second linkages 220 and 222 of FIG. 2, from first and second linkages 220 and 222 to latch key 226 of FIG. 2, and from latch key 226 to tubular groove 316 of FIG. 3. The additional force applied from latch key 226 to tubular groove 316 anchors latch key 226 into tubular groove 316 during the cutting operation to prevent premature shifting or movement of downhole cutting tool positioning assembly 200 during the cutting operation.

After completion of the cutting operations, drive nut 204 is rotated in a second direction opposite of the direction illustrated by arrow 507 to shift drive nut 204 from the second position illustrated in FIG. 5D towards the first position illustrated in FIG. 5A. In the embodiment of FIG. 5D, pressure piston 206 is coupled to drive nut 204 where shifting drive not 204 from the second drive nut position towards the first drive nut position also shifts pressure piston 206 from the second pressure piston position illustrated in FIG. 5D towards the first pressure piston position illustrated in FIG. 5A, thereby reducing force or pressure applied to fluid 210 of FIG. 2. The reduction of pressure or force to fluid 210, in turn, reduces the force or pressure applied by fluid 210 to anchor position 214, thereby shifts or causes anchor piston 214 of FIG. 2 to shift from the second anchor piston position illustrated in FIG. 3B towards the first anchor piston position illustrated in FIG. 3A. Moreover, anchor piston 214, in turn, shifts sleeve 216 of FIG. 2 from the second sleeve position illustrated in FIG. 3B towards the first sleeve position illustrated in FIG. 3A as anchor piston 214 shifts from the second anchor piston position towards the first anchor piston position. Further, sleeve 216, in turn, shifts slider hub 217 of FIG. 2 from the second slider hub position illustrated in FIG. 3B towards the first slider hub position illustrated in FIG. 3A as sleeve 216 shifts from the second sleeve position towards the first sleeve position. Further, slider hub 217 shifts first linkage 220 of FIG. 2 that is coupled to latch key 226 of FIG. 2 as slider hub 217 shifts from the second slider hub position towards the first slider hub position, thereby reducing the force applied by latch key 226 to tubular groove 316 of FIG. 3B and shifting latch key 226 out of tubular groove 316.

Figure 6:
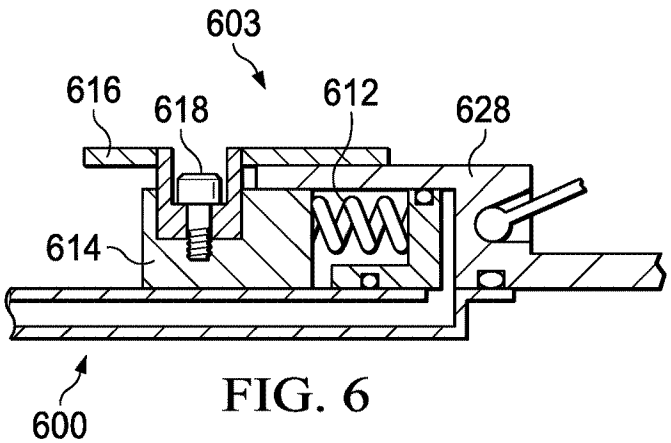
FIG. 6 is a cross-sectional view of a section of the anchoring sub-assembly of a cutting tool positioning assembly that is similar to the cutting tool positioning assembly of FIG. 2 in accordance with another embodiment.

FIG. 6 is a cross-sectional view of a section of an anchoring sub-assembly 603 of a downhole cutting tool positioning assembly 600 similar to downhole cutting tool positioning assembly 200 of FIG. 2 in accordance with another embodiment. In the embodiment of FIG. 6, a spring 612 is positioned between an anchor piston 614 and a fixed hub 628 of anchoring sub-assembly 603. Further, anchor piston 614 is coupled to sleeve 616 via key 618. In the embodiment of FIG. 6 pressurized fluid (as shown in FIG. 2) comes into contact with spring 612, which, in turn, compresses spring 612 to a compressed state. Spring 612, in turn, applies a force to anchor piston 614 as spring 612 shifts to a natural state. Force applied by spring 612 to anchor piston 614 shifts anchor piston 614 from a first anchoring piston position to a second anchoring piston position, which, in turn, shifts sleeve 616 from a first sleeve position to a second sleeve position. In some embodiments, downhole cutting tool positioning assembly 600 includes spring 612 in lieu of spring 212 of FIG. 2. In some embodiments, downhole cutting tool positioning assembly 200 includes both spring 612 and spring 212. In the embodiment of FIG. 6, other components of downhole cutting tool positioning assembly 600 are similar to or identical to the corresponding components of downhole cutting tool positioning assembly 200, which are disclosed herein and are illustrated in FIGS. 2-5D.

Figure 7:
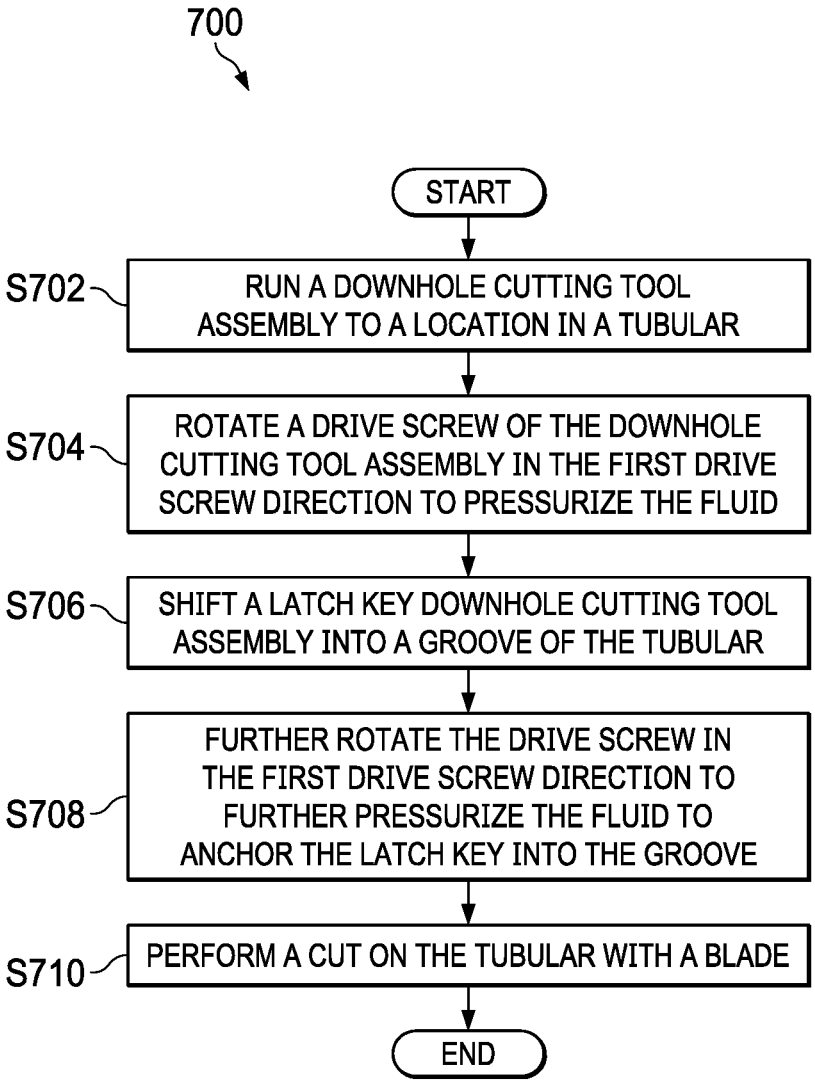
FIG. 7 is a flow chart illustrating another process to cut a tubular.

FIG. 7 is a flow chart of a process 700 to cut a tubular. Although the operations in process 700 are shown in a particular sequence, certain operations may be performed in different sequences or at the same time where feasible. At block S702, a downhole cutting tool positioning assembly is run to a location in a tubular. FIG. 1 illustrates running downhole cutting tool positioning assembly 122 into tubular 116. At block S704, a drive screw of the downhole cutting tool positioning assembly is rotated in the first drive screw direction to pressurize the fluid. In that regard, FIG. 5B illustrates rotating drive screw 202 in the direction illustrated by arrow 501 to shift drive nut 204 from the first drive nut position illustrated in FIG. 5A to the drive nut position illustrated in FIG. 5B. Further, additional operations described herein are performed to shift piston 206, apply pressure to fluid 210, shift anchor piston 214 from the first anchor piston position towards the second anchor piston position, shift sleeve 216 from the first sleeve position towards the second sleeve position, shift slider hub 217 from the first slider hub position towards the second slider hub position, which, in turn, shifts latch key 226 of downhole cutting tool positioning assembly 200 of FIG. 2.

At block S706, a latch key downhole cutting tool positioning assembly is shifted into a groove of the tubular. FIG. 3B illustrates latch key 226 shifted into tubular groove 316 as a result of the operations described herein to shift piston 206, apply pressure to fluid 210, shift anchor piston 214 from the first anchor piston position towards the second anchor piston position, shift sleeve 216 from the first sleeve position towards the second sleeve position, shift slider hub 217 of downhole cutting tool positioning assembly 200 of FIG. 2 from the first slider hub position towards the second slider hub position. At block S708, the drive screw is further rotated in the first drive screw direction to further pressurize the fluid to anchor the latch key into the groove. In that regard, FIGS. 5C-5D illustrate further rotating drive screw in the direction illustrated by arrow 507 to shift drive screw 202 from the third drive screw position illustrated in FIG. 5C to the second drive screw position illustrated in FIG. 5D, which, in turn, shifts pressure piston 206 from the third pressure piston position illustrated in FIG. 3B to the second pressure piston position illustrated in FIG. 5D, where force applied to shift pressure piston 206 is translated through pressurizing of fluid 210 of FIG. 2 and shifting of anchor piston 214, sleeve 216, slider hub 217, first and second linkages 220 and 222, respectively, and to latch key 226 of downhole cutting tool positioning assembly 200, thereby anchoring latch key 226 in tubular groove 316 of FIG. 3B. In some embodiments, after latch key 226 is anchored in tubular groove 316, one or more adjustments are made to the positioning and orientation of cutting blade 406 of FIG. 4.

At block S710, a cut is performed on the tubular with a blade. In the embodiment of FIG. 4, and after completion of anchor operation, a cut is made by blade 406 within cutting window 402 while latch key 226 is anchored within tubular groove 316 to prevent unwanted movement or shifting of downhole cutting tool positioning assembly 200 during the cutting operation. In some embodiments, after a cut is made, operations described herein are performed to rotate the drive screw in the second direction, which, in turn, shifts the drive nut and pressure piston from the second drive nut and pressure piston positions towards the first drive and pressure piston positions, respectively. The foregoing, in turn, shifts the latch key or allows the latch key to be shifted out of the tubular groove that the latch key was previously anchored in. In one or more of such embodiments, the downhole cutting tool positioning assembly is run to a second location of the tubular, and the operations performed at blocks S704, S706, S708, and S710 are repeated to make another cut to the tubular at or near the second location. In one or more of such embodiments, the downhole cutting tool positioning assembly is retrieved at the surface after performing the operation at block S710.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. For instance, although the flowcharts depict a serial process, some of the steps/processes may be performed in parallel or out of sequence, or combined into a single step/process. The scope of the claims is intended to broadly cover the disclosed embodiments and any such modification. Further, the following clauses represent additional embodiments of the disclosure and should be considered within the scope of the disclosure.

Clause 1, a downhole cutting tool positioning assembly, comprising a drive screw; a drive nut coupled to the drive screw and configured to shift from a first drive nut position to a second drive nut position as the drive screw rotates in a first drive screw direction; a pressure piston configured to shift from a first pressure piston position to a second pressure piston position in response to force applied to the pressure piston; a chamber comprising a fluid that is pressurized by the pressure piston as the pressure piston shifts from the first pressure piston position towards the second pressure piston position; a sleeve configured to slide from a first sleeve position towards a second sleeve position in response to pressure from the fluid; and a latch key having a profile configured to shift radially to engage a tubular groove having a matching profile as the sleeve shifts from the first sleeve position towards the second sleeve position.

Clause 2, the downhole cutting tool positioning system of clause 1, further comprising an anchor piston that is coupled to the sleeve and configured to shift from the first anchor piston position towards a second anchor piston position in response to the pressure from the fluid, wherein the sleeve is configured to slide from the first sleeve position towards the second sleeve position as the anchor piston shifts from the first anchor piston position towards the second anchor piston position.

Clause 3, the downhole cutting tool positioning assembly of clause 2, further comprising a slider hub that is coupled to the sleeve and configured to shift from a first slider hub position to a second slider hub position as the sleeve shifts from the first sleeve position towards the second sleeve position, wherein the latch key is configured to shift radially outwards as the slider hub shifts from the first slider hub position towards the second slider hub position.

Clause 4, the downhole cutting tool positioning assembly of claim 3, further comprising a first linkage and a second linkage that are coupled to each other and to latch key at a bendable joint that is configured to shift radially outwards from a first bendable joint position to a second bendable joint position as the slider hub shifts from the first slider hub position towards the second slider hub position, wherein the latch key is configured to shift radially outwards as the bendable joint shifts from the first bendable joint position towards the second bendable joint position.

Clause 5, the downhole cutting tool positioning assembly of clause 4, wherein the first linkage comprises a first end that is coupled to the slider hub, wherein the second linkage comprises a first end that is coupled to a fixed hub of the downhole cutting tool positioning assembly, and each of the first linkage and the second linkage has a second end that is coupled to the second end of the corresponding linkage to form the bendable joint.

Clause 6, the downhole cutting tool positioning assembly of any of clauses 3-5, further comprising a key that fixedly couples the slider hub to the sleeve.

Clause 7, the downhole cutting tool positioning assembly of any of clauses 2-6, further comprising a fixed hub positioned between the chamber and the latch key; and a spring positioned between the anchor piston and the fixed hub, wherein the spring is configured to compress from a natural state to a compressed state in response to pressure from the pressurized fluid, and wherein force applied by the spring to the anchor piston as the spring shifts from the compressed state to the natural state shifts the anchor piston from the first anchor piston position towards the second anchor piston position.

Clause 8, the downhole cutting tool positioning assembly of clauses 1-7, further comprising a spring positioned between the drive nut and the pressure piston and configured to compress from a natural state to a compressed state as the drive nut shifts from the first drive nut position towards the second drive nut position, and wherein force applied by the spring to the pressure piston as the spring shifts from the compressed state to the natural state shifts the pressure piston from the first pressure piston position towards the second pressure piston position.

Clause 9, the downhole cutting tool positioning assembly of clauses 1-8, wherein the drive nut is not in contact with the pressure piston while the drive nut is in the first drive nut position, wherein the drive nut is configured to contact the pressure piston as the drive nut shifts from the first drive nut position towards the second drive nut position, and wherein force applied by the drive nut, after the drive nut contacts the pressure piston, shifts the pressure piston towards the second pressure piston position.

Clause 10, the downhole cutting tool positioning assembly of any of clauses 1-9, wherein the drive screw is configured to rotate in a second drive screw direction, and wherein the drive nut is configured to shift from the second drive nut position towards the first drive nut position as the drive screw rotates in the second drive screw direction.

Clause 11, the downhole cutting tool positioning assembly of any of clauses 1-10, further comprising a blade configured to perform a cut on a downhole tubular after the latch key has engaged the tubular groove.

Clause 12, a method to cut a tubular, the method comprising running a downhole cutting tool positioning assembly to a location in a tubular; rotating a drive screw of the downhole cutting tool positioning assembly in the first drive screw direction to pressurize the fluid; shifting a latch key downhole cutting tool positioning assembly into a groove of the tubular; further rotating the drive screw in the first drive screw direction to further pressurize the fluid to anchor the latch key into the groove; and performing a cut on the tubular with a blade.

Clause 13, the method of clause 12, further comprising shifting a pressure piston of the downhole cutting tool positioning assembly that is configured to shift from a first pressure piston position to a second pressure piston position, wherein the fluid pressurized by the pressure piston as the pressure piston shifts from the first position towards the second position.

Clause 14, the method of clause 13, further comprising sliding a sleeve of the downhole cutting tool positioning assembly from a first sleeve position towards a second sleeve position in response to pressure from the fluid, wherein the latch key is shifted into the groove of the tubular as the sleeve shifts from the first sleeve position towards the second sleeve position.

Clause 15, the method of clause 14, further comprising shifting an anchor piston of the downhole cutting tool positioning assembly that is coupled to the sleeve from the first anchor piston position towards a second anchor piston position in response to the pressure from the fluid, wherein the sleeve slides from the first sleeve position towards the second sleeve position as the anchor piston shifts from the first anchor piston position towards the second anchor piston position.

Clause 16, the method of clause 15, further comprising shifting a slider hub of the downhole cutting tool positioning assembly that is coupled to the sleeve from a first slider hub position to a second slider hub position, wherein the latch key shifts into the groove as the slider hub shifts from the first slider hub position towards the second slider hub position.

Clause 17, the method of clause 16, further comprising, after the latch key is anchored into the groove, adjusting a positioning of the blade before actuating the blade.

Clause 18, the method of any of clauses 13-17, further comprising after performing the cut, rotating the drive screw in the second drive screw direction to reduce pressure on the fluid; and shifting the latch key of the downhole cutting tool positioning assembly out of the groove of the tubular.

Clause 19, the method of clause 18, further comprising running the downhole cutting tool positioning assembly to a second location in the tubular; rotating a drive screw in the first drive screw direction to pressurize the fluid; shifting a latch key into a groove of the tubular; further rotating the drive screw in the first drive screw direction to further pressurize the fluid to anchor the latch key into the groove; and performing a second cut on the tubular with the blade.

Clause 20, the method of clauses 18 or 19, further comprising retrieving the downhole cutting tool positioning assembly from the tubular.

As used herein, the singular forms "a", "an," and "the" are intended to include the plural forms as well, unless the context clearly indicates otherwise. It will be further understood that the terms "comprise" and/or "comprising," when used in this specification and/or the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

What is claimed is:

1. A downhole cutting tool positioning assembly, comprising:

a drive screw;

a drive nut coupled to the drive screw and configured to shift from a first drive nut position to a second drive nut position as the drive screw rotates in a first drive screw direction;

a pressure piston configured to shift from a first pressure piston position to a second pressure piston position in response to force applied to the pressure piston;

a chamber comprising a fluid that is pressurized by the pressure piston as the pressure piston shifts from the first pressure piston position towards the second pressure piston position;

a sleeve configured to slide from a first sleeve position towards a second sleeve position in response to pressure from the fluid; and a latch key having a profile configured to shift radially to engage a tubular groove having a matching profile as the sleeve shifts from the first sleeve position towards the second sleeve position.

2. The downhole cutting tool positioning system of claim 1, further comprising:

an anchor piston that is coupled to the sleeve and configured to shift from the first anchor piston position towards a second anchor piston position in response to the pressure from the fluid, wherein the sleeve is configured to slide from the first sleeve position towards the second sleeve position as the anchor piston shifts from the first anchor piston position towards the second anchor piston position.

3. The downhole cutting tool positioning assembly of claim 2, further comprising:

a slider hub that is coupled to the sleeve and configured to shift from a first slider hub position to a second slider hub position as the sleeve shifts from the first sleeve position towards the second sleeve position, wherein the latch key is configured to shift radially outwards as the slider hub shifts from the first slider hub position towards the second slider hub position.

4. The downhole cutting tool positioning assembly of claim 3, further comprising:

a first linkage and a second linkage that are coupled to each other and to latch key at a bendable joint that is configured to shift radially outwards from a first bendable joint position to a second bendable joint position as the slider hub shifts from the first slider hub position towards the second slider hub position, wherein the latch key is configured to shift radially outwards as the bendable joint shifts from the first bendable joint position towards the second bendable joint position.

5. The downhole cutting tool positioning assembly of claim 4, wherein the first linkage comprises a first end that is coupled to the slider hub, wherein the second linkage comprises a first end that is coupled to a fixed hub of the downhole cutting tool positioning assembly, and each of the first linkage and the second linkage has a second end that is coupled to the second end of the corresponding linkage to form the bendable joint.

6. The downhole cutting tool positioning assembly of claim 3, further comprising a key that fixedly couples the slider hub to the sleeve.

7. The downhole cutting tool positioning assembly of claim 2, further comprising:

a fixed hub positioned between the chamber and the latch key; and a spring positioned between the anchor piston and the fixed hub, wherein the spring is configured to compress from a natural state to a compressed state in response to pressure from the pressurized fluid, and wherein force applied by the spring to the anchor piston as the spring shifts from the compressed state to the natural state shifts the anchor piston from the first anchor piston position towards the second anchor piston position.

8. The downhole cutting tool positioning assembly of claim 1, further comprising a spring positioned between the drive nut and the pressure piston and configured to compress from a natural state to a compressed state as the drive nut shifts from the first drive nut position towards the second drive nut position, and wherein force applied by the spring to the pressure piston as the spring shifts from the compressed state to the natural state shifts the pressure piston from the first pressure piston position towards the second pressure piston position.

9. The downhole cutting tool positioning assembly of claim 1, wherein the drive nut is not in contact with the pressure piston while the drive nut is in the first drive nut position, wherein the drive nut is configured to contact the pressure piston as the drive nut shifts from the first drive nut position towards the second drive nut position, and wherein force applied by the drive nut, after the drive nut contacts the pressure piston, shifts the pressure piston towards the second pressure piston position.

10. The downhole cutting tool positioning assembly of claim 1, wherein the drive screw is configured to rotate in a second drive screw direction, and wherein the drive nut is configured to shift from the second drive nut position towards the first drive nut position as the drive screw rotates in the second drive screw direction.

11. The downhole cutting tool positioning assembly of claim 1, further comprising a blade configured to perform a cut on a downhole tubular after the latch key has engaged the tubular groove.

12. A method to cut a tubular, the method comprising:

running a downhole cutting tool positioning assembly to a location in a tubular;

rotating a drive screw of the downhole cutting tool positioning assembly in the first drive screw direction to pressurize a fluid;

shifting a latch key downhole cutting tool positioning assembly into a groove of the tubular;

further rotating the drive screw in the first drive screw direction to further pressurize the fluid to anchor the latch key into the groove; and performing a cut on the tubular with a blade.

13. The method of claim 12, further comprising shifting a pressure piston of the downhole cutting tool positioning assembly that is configured to shift from a first pressure piston position to a second pressure piston position, wherein the fluid pressurized by the pressure piston as the pressure piston shifts from the first position towards the second position.

14. The method of claim 13, further comprising sliding a sleeve of the downhole cutting tool positioning assembly from a first sleeve position towards a second sleeve position in response to pressure from the fluid, wherein the latch key is shifted into the groove of the tubular as the sleeve shifts from the first sleeve position towards the second sleeve position.

15. The method of claim 14, further comprising shifting an anchor piston of the downhole cutting tool positioning assembly that is coupled to the sleeve from the first anchor piston position towards a second anchor piston position in response to the pressure from the fluid, wherein the sleeve slides from the first sleeve position towards the second sleeve position as the anchor piston shifts from the first anchor piston position towards the second anchor piston position.

16. The method of claim 15, further comprising shifting a slider hub of the downhole cutting tool positioning assembly that is coupled to the sleeve from a first slider hub position to a second slider hub position, wherein the latch key shifts into the groove as the slider hub shifts from the first slider hub position towards the second slider hub position.

17. The method of claim 16, further comprising, after the latch key is anchored into the groove, adjusting a positioning of the blade before actuating the blade.

18. The method of claim 13, further comprising:

after performing the cut, rotating the drive screw in the second drive screw direction to reduce pressure on the fluid; and shifting the latch key of the downhole cutting tool positioning assembly out of the groove of the tubular.

19. The method of claim 18, further comprising:

running the downhole cutting tool positioning assembly to a second location in the tubular;

rotating a drive screw in the first drive screw direction to pressurize the fluid;

shifting a latch key into a groove of the tubular;

further rotating the drive screw in the first drive screw direction to further pressurize the fluid to anchor the latch key into the groove; and performing a second cut on the tubular with the blade.

20. The method of claim 18, further comprising retrieving the downhole cutting tool positioning assembly from the tubular.

* * * * *